United States Patent [19]

Aarflot

[11] Patent Number: 4,514,916

[45] Date of Patent: May 7, 1985

[54] SOLE FOR CROSS-COUNTRY SKI SHOE

[75] Inventor: Kjell Aarflot, Oslo, Norway

[73] Assignee: Nike, Inc., Beaverton, Oreg.

[21] Appl. No.: 386,352

[22] Filed: Jun. 8, 1982

[51] Int. Cl.[3] ..... A43B 5/04; A63C 9/00

[52] U.S. Cl. ..... 36/117; 280/615

[58] Field of Search ..... 36/117–121, 36/25 R; 280/615, 609, 636

[56] References Cited

U.S. PATENT DOCUMENTS

| | | | |
|---|---|---|---|
| 2,276,826 | 3/1942 | Crowther . | |
| 3,100,354 | 8/1963 | Lombard et al. | 36/25 R |
| 3,490,155 | 1/1970 | Herunter | 36/117 X |
| 3,613,270 | 10/1971 | Eie . | |
| 3,775,866 | 12/1973 | Marker . | |
| 3,807,062 | 4/1974 | Spier . | |
| 3,842,518 | 10/1974 | Famolare, Jr. . | |
| 3,907,319 | 9/1975 | Berlied, Jr. . | |
| 4,062,134 | 12/1977 | Ryder | 36/117 X |
| 4,082,312 | 4/1978 | Johnson . | |
| 4,129,319 | 12/1978 | Strohmeier . | |
| 4,154,008 | 5/1979 | Jacobs . | |
| 4,165,888 | 8/1979 | Berhardson . | |
| 4,186,500 | 2/1980 | Salzman . | |
| 4,312,141 | 1/1982 | Mayer et al. . | |
| 4,330,949 | 5/1982 | Kubelka et al. . | |
| 4,335,531 | 6/1982 | Salomon | 36/117 |

FOREIGN PATENT DOCUMENTS

| | | | |
|---|---|---|---|
| 1140959 | 2/1983 | Canada | 280/615 |
| 2431692 | 1/1975 | Fed. Rep. of Germany | 36/117 |
| 7815740 | 9/1978 | Fed. Rep. of Germany . | |
| 2338719 | 8/1977 | France . | |
| 140325 | 7/1976 | Norway . | |
| 228420 | 11/1943 | Switzerland . | |
| 462668 | 10/1968 | Switzerland | 36/117 |
| 619147 | 9/1980 | Switzerland . | |

OTHER PUBLICATIONS

Salomon SR 90 Racing Advertisement.

*Primary Examiner*—James Kee Chi

*Attorney, Agent, or Firm*—Banner, Birch, McKie & Beckett

[57] ABSTRACT

An outer sole for a cross-country ski shoe is disclosed. The outer sole is comprised of a sole plate member having toe, forefoot, arch and heel sections. The lower surface of the sole plate member has a pair of transversely spaced, longitudinally extending side walls defining between them a longitudinally extending groove. The groove has a width sufficient to receive the ski. The groove extends through at least the forefoot, arch and heel sections.

9 Claims, 12 Drawing Figures

SOLE FOR CROSS-COUNTRY SKI SHOE

TECHNICAL FIELD

The present invention relates to an improvement in a sole for a cross-country shoe, and also to a toe binding especially suitable for use with an embodiment of the improved sole.

BACKGROUND OF THE INVENTION

Developments in the cross-country ski sport in recent years have resulted in the use of steadily more lightweight ski equipment including lighter weight shoes, skis and bindings.

In regard to soles for cross-country ski shoes, the use of leather is being replaced by synthetic materials such as rubber and plastics, for example nylon. Toe bindings of various types have been made lightweight and smaller, particularly in connection with the development of so-called "snabel" or "nose tip shoes", where an extremity or nose on the shoe sole is locked into the toe binding.

These developments have resulted in lightweight and comfortable equipment, particularly for competition skiers. However, these developments have simultaneously resulted in steadily greater problems in obtaining a dependable and torque-stable connection between the shoe and the ski such that lateral movements of the shoe in the binding and also of the shoe itself are avoided. Such lateral movements result because the heel portion of the shoe becomes more or less displaced from its support on the ski, resulting in unstable and uncomfortable skiing. In order to avoid this shortcoming, attempts have been made to develop better toe bindings and various forms of heel support in order to hinder such lateral displacement of the shoe. The need for steady support of the shoe on the ski is even more important because of the use of present day narrow and lighter skis and very lightweight and thin cross-country shoes, frequently made from a more or less elastic textile material.

Many different solutions have been proposed to improve biasing support and locking of the shoe onto the ski. For example, the front of the sole of the shoe is locked into a toe binding which includes a clamp, side ears or walls and upwardly extending pins. The tip or toe extension of the sole is placed between the side walls, the pins extend into apertures in the toe extension and the clamp secures the toe extension in position. Currently several types of commercial bindings which are adapted to receive a standardized sole are available. However, special types of commercial bindings are also available. Further, various types of heel supports are currently in use. One type of heel support uses V-shaped groove in the heel of the sole which fits around a complementary V-shaped projection attached to the ski. In another prior art technique, crosswise or longitudinally extending grooves or the like are formed in the surface of the sole between toe and heel. Norwegian Pat. No. 140 325 discloses a cross-country ski shoe sole provided with a pair of longitudinal grooves or ridges adapted to receive opposed side edges of the ski. These grooves or ridges are located in the forefoot section of the sole.

SUMMARY OF THE INVENTION

The present invention relates to an outersole for a cross-country ski shoe. The outer sole includes a sole plate member having a toe section, a forefoot section, an arch section, a heel section, an upper surface for attachment to a shoe upper and a lower surface adapted to contact a ski. The lower surface has a pair of transversely spaced, longitudinally extending side wall defining between them a longitudinally extending groove. The groove has a width sufficient for receiving the ski so that the side walls of the groove extend about the side walls of the ski. The groove extends through at least the forefoot, arch and heel sections.

A sole in accordance with the present invention is constructed with the understanding that satisfactory lateral support can be optimized if the engagement between the sole and the ski is always present, i.e., present even during skiing motion when the shoe is bent up from the ski.

A sole for cross-country shoe in accordance with the invention is generally characterized in that substantially the entire sole from the toe to the heel is provided with a continuous recess or "groove", dimensioned for grasping around opposite side edges of the ski. In one embodiment the groove extends from immediately behind the toe extension to the heel edge. In another embodiment the groove extends into the toe extension.

By having the groove extend continuously from the toe portion of the sole to the heel edge, whether or not the groove extends into the toe extension, the need of a heel plate with the V-shaped projection is eliminated. The coupling of the shoe to the ski is thus simpified, and less elements have to be attached to the ski. Since less elements have to be attached to the ski, the chance of weakening the ski because of the attachment of elelments to the ski is reduced. This use of the continuous longitudinal groove also has the advantage that a continuous lateral alignment and correction mechanism, i.e., the edges of the side walls of the grooves extending around and engaging the sides of the ski, tends to urge the shoe into lateral alignment with the ski during most of the up and down motion of the foot.

In the embodiment where the groove extends into the toe extension of the shoe sole, the side walls of the groove which fit into the binding grasps the ski edges. A toe binding which is specially adapted for this embodiment of a sole is also part of the invention disclosed herein.

There are therefore two embodiments of shoe soles in accordance with the invention, namely a first embodiment adapted for standard toe bindings wherein the groove does not extend into the toe extension, and one embodiment adapted for the new binding in accordance with the invention wherein the groove extends into the toe extension.

The recess or groove in the sole should preferably be deep, and for instance comprise about 10% of the width of the ski, i.e., about 5 mm deep for a normal cross-country ski. The sides of the recess should extend either normal to the surface of the sole, or at a small tilt outwards, such that a centering effect occurs when the shoe is set down onto the ski. Since the ski shoe will generally always be to some extent in engagement with the ski, it is not necessary to use a separate heel fitting. The sole should preferably be of the "snabel type," i.e., having a forwardly directed to extension with the usual apertures for pins positioned on the binding plate. Alternatively, other locking means can be used.

With the embodiment of a sole which is to be used with industry standard "Nordic Norm" toe bindings both 75 mm and extended toe 50 mm, the thickness of the ridges in front should decrease towards zero at the point where the sole comes into engagement with the binding armature. Otherwise the sole would be pressed upwards by the base plate of the binding. This embodiment could also be made for use with most any toe binding.

A further new feature with the shoe sole in accordance with the invention is that the longitudinal center portion of the sole, i.e. the arch area, is provided with a lateral widening or extension, particularly on the inside of the foot, to an extent such that the groove or recess in the sole can be extended continuously backwards through this center (arch) portion to the heel portion of the sole. Continuous engagement between the sole and the ski at both sides of the sole is thus obtained. Furthermore, an evenly distributed, full support between the shoe sole and the ski occurs. This lateral extension particularly on the medial side, provides additional lateral support to aid in edging the skis, thus enhacing the control ability of the skis. This is in contrast to typical cross-country ski shoe soles where the center portion is rather narrow, resulting in a center zone of the sole that has no or very little support against the ski.

A further feature in accordance with the invention relating to the lateral expansion of the sole, is that the shoe above the lateral sole expansion can be built up or supplied with a special build up.

The invention also comprises a new type of toe binding which accomodates a sole in which the groove extends all the way to the tip of the sole into the toe extension. A toe binding in accordance with the invention is generally characterized simply by a clamp fitting which can be locked in clamping position against the tip of the sole.

In a preferred embodiment of a binding in accordance with the invention the clamp fitting includes a front guide which prevents lateral movements of the clamp fitting. In one embodiment the clamp fittings are pivotally supported on a transversely extending bolt or the like journalled in a binding armature attached to the ski. In another embodiment a laterally extending guide in the shape of flange members is provided on the clamp fittings and on the plate armature attached to the ski.

A binding in accordance with the invention may be provided with various kinds of mechanisms for clamping and locking the clamp armature against the tip of the sole. In one embodiment a threaded bolt is attached to the plate armature in connection with a wing nut which rests on and is tightened against the clamp armature. Another embodiment uses an eccentrically journalled pivot arm.

One embodiment of a binding in accordance with the invention distinguishes from conventional binding in that the plate armature attached to the ski is made without the usual side ears adapted to rest against the side edges of the sole, since the locking of the shoe sole against lateral movement is obtained entirely through the special groove in the sole which extends into the toe extension straddling the side edges of the ski. Additionally, the sole can be arranged with apertures engaging complementary pins or the like attached to the binding plate armature. In another embodiment of the binding, the conventional side ears on the plate armature are replaced with downwardly pointing side ears provided on the clamp armature. Such downwardly pointing side ears superimpose the tip of the sole (toe extension) including the opposed side edges which extend over the side edges of the ski. With this embodiment has the special advantage that the binding can be used with conventional ski soles as well as with the special shoe sole in accordance with the invention provided with a longitudinally extending groove or recess along the tip of the sole.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof and to the accompanying descriptive matter in which there is illustrated and described preferred embodiments of the invention.

Figure 5:
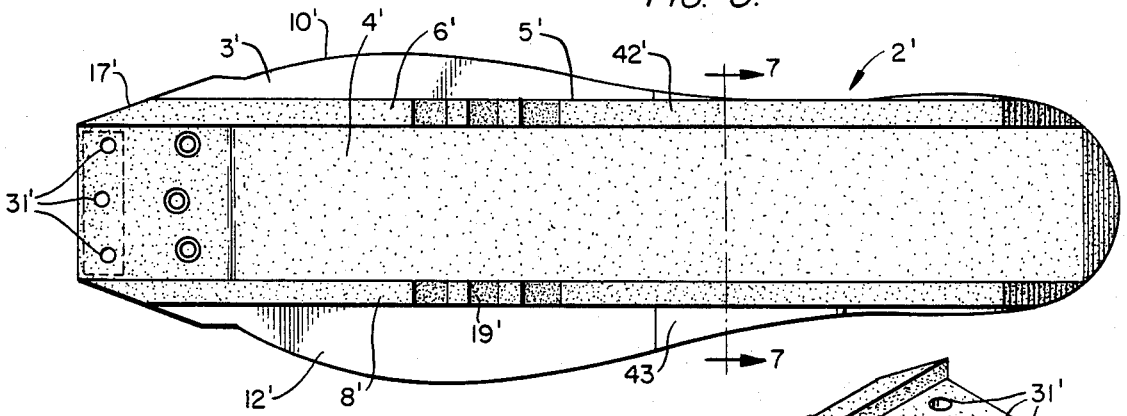
FIG. 5 is a plan view of another embodiment of a sole in accordance with the present invention.
Figure 7:
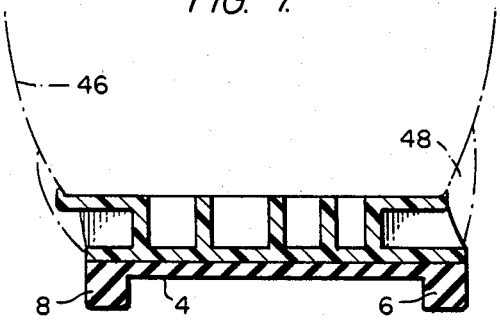
Figure 8:
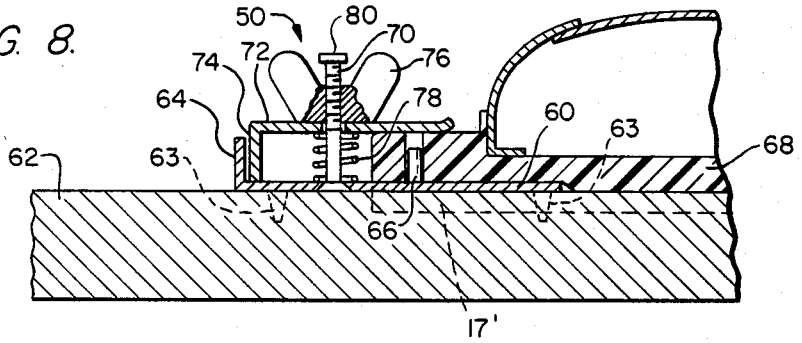
Figure 9:
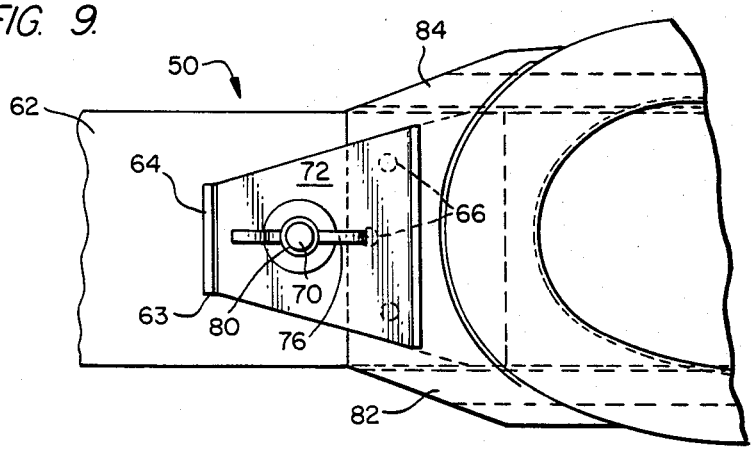
Figure 10:
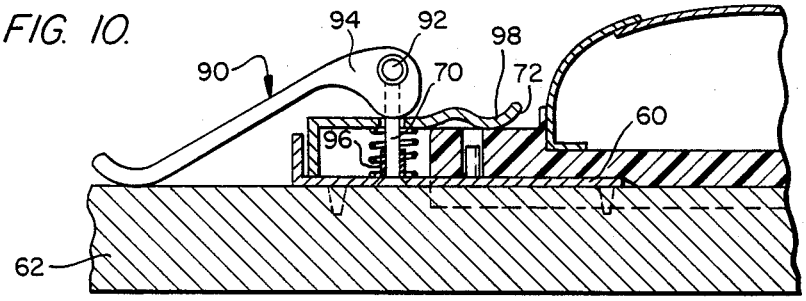
Figure 11:
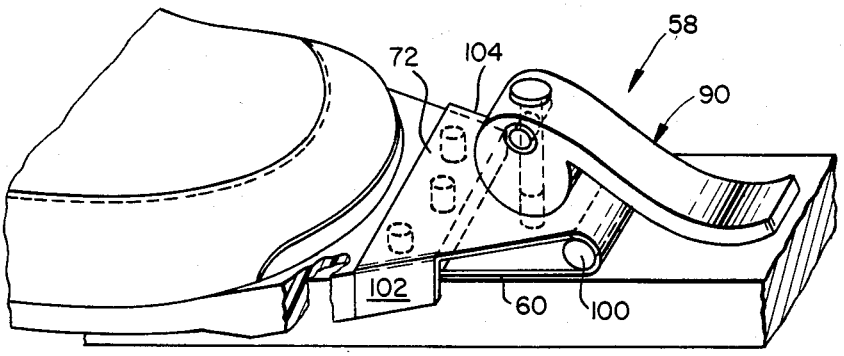

FIG. *6a* is a fragmentary perspective view of the tip portion of a variation of a sole in accordance with the invention;

FIG. 7 is a cross-section taken generally along line 7—7 in FIG. 5;

FIGS. 8 and 9 are a lateral view in section and a plan view, respectively, of a ski binding in accordance with the invention, shown coupled to a ski shoe having a sole in accordance with the invention;

FIG. 10 is a lateral view similar to FIG. 8, illustrating another embodiment of ski binding; and FIG. 11 is a schematic perspective view illustrating a further embodiment of ski binding.

DETAILED DESCRIPTION OF THE INVENTION

In FIGS. 1–4, where like reference numbers designate like parts, a sole, comprising a sole plate member in accordance with the present invention is designated generally as 2. Sole plate member 2 is preferably molded from a plastic or a rubber- or plastic-like material. Sole plate member 2 can be divided into a number of sections, related approximately to the portions of the foot located above the respective sections. For example, a toe section is located between lines $L_1$ and $L_2$; a forefoot section is located between lines $L_2$ and $L_3$; an arch section is located by line $L_3$ and $L_4$; a heel section is located rearward of line $L_1$; and a toe extension is located foreward of line $L_1$. Sole plate member 2 has a longitudinally extending rectilinear recess or "groove" 4 on its bottom or underside defined between a pair of opposing, transversely spaced edges or side walls 6 and 8. Side walls 6 and 8 extend normal to or substantially normal to, i.e. at a slight outward angle to, the plane of sole plate member 2 or the bottom face of groove 4. The bottom face of groove 4 is designed to rest against the top side of the ski. The width of the groove corresponds to the width "B" of a ski which is to be used with the sole. Side walls 6, 8 thus extending about the side walls of the ski. Preferably, sole plate member 2 is formed of two pieces 3 and 5, which are secured to one another. Piece 3 is preferably formed of thermoplastic which is flexible yet sufficiently rigid to provide the required degree of torsional stability. Piece 3 is attached to the shoe upper. Piece 5 is preferably formed of thermoplastic or rubber like material having the skid resistant property of rubber. Piece 5 has groove h formed longitudinally in it.

Figure 2:
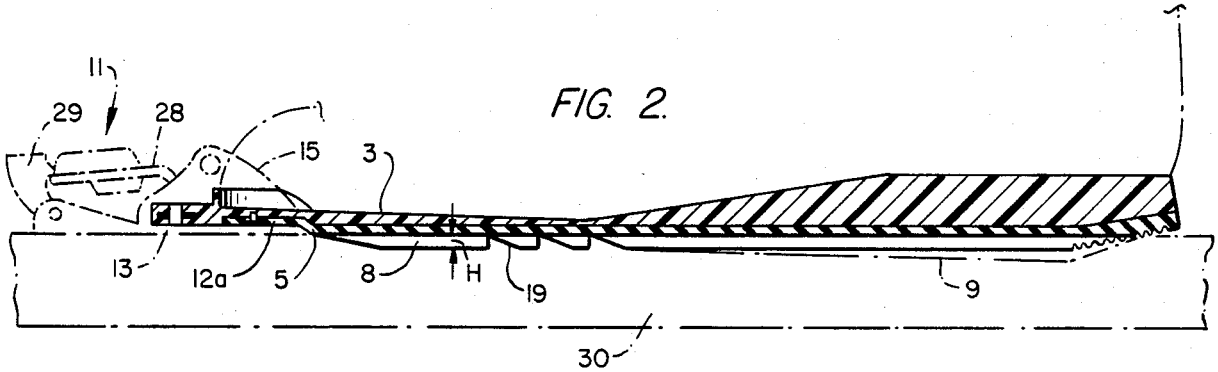
FIG. 2 is a longitudinal sectional view taken generally along line 2—2 of FIG. 1 illustrating the sole mounted on a ski.
Figure 3:
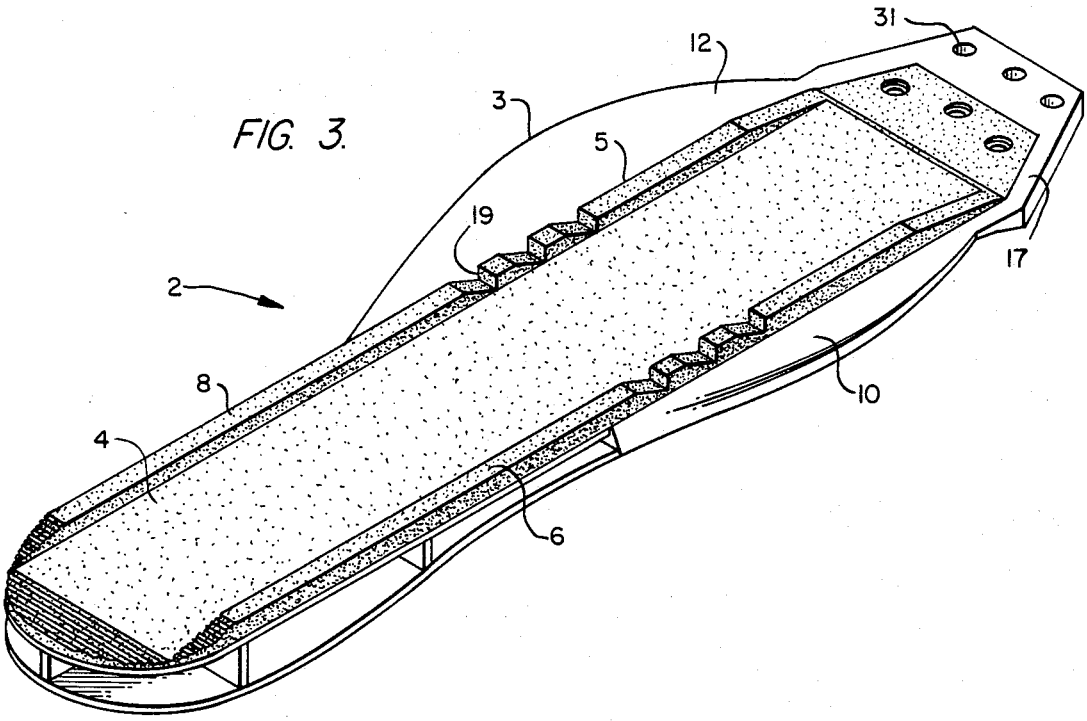
FIG. 3 is a perspective view of the bottom side of the sole of FIG. 1.

FIG. 2 illustrates the depth profile of groove 4 as "H". This depth can, if desired, vary somewhat in correspondence with the contour of lateral portions 10 and 12 of sole plate member 2, but should in average have a depth of about 4–7 mm. The depth of the groove can if desired increase towards the heel portion as shown by dot-dash lines 9 in FIG. 2. The front toe portion sole plate member 2 and groove 4 can be varied in accordance with the type of toe binding which will be used.

Figure 4:
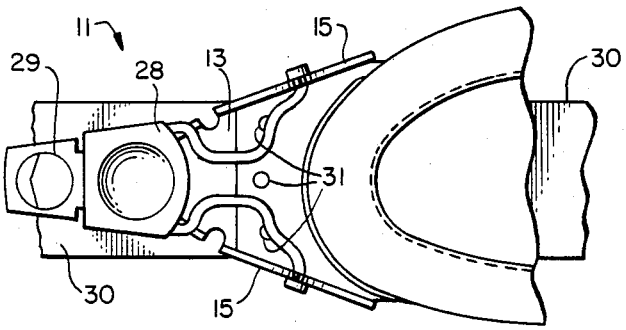
FIG. 4 is a top plan view of the toe extension of the sole of FIG. 1 attached to a ski by a conventional binding.

The attachment of sole plate member 2 and the shoe to which it is attached to a typical cross-country ski 30 by a binding 11 is shown in FIGS. 2 and 4. Binding 11 includes a binding plate 13, clamp 28 and clamp retainer 29. Binding plate 13 includes a pair of opposed upwardly extending side walls 15 and pins, not shown. Clamp 28 is pivotably carried by the side walls 15, and clamp retainer 29 is spring biased into a locking position onto clamp 28. A toe extension 17 of sole plate member 2 has a plurality of apertures 31 for alignment with the pins. To attach sole plate member 2 to ski 30, clamp retainer 29 is moved to release clamp and clamp 28 is pivoted upward. Toe extension 17 is slipped between side walls 15 and the pins pass into apertures 31. Thereafter clamp 28 is pivoted downward on top of toe extension 17 and secured in position by claim retainer 29.

Sole plate member 2, illustrated in FIGS. 1–4, is designed to be used with the conventional toe binding 11 which includes binding plate 13 having side walls 15 of the type "Rottefella." Front portions 10*a* and 10*b* of the lateral portions 10 and 12 therefore should be thinned off in the front, such that the thickness of the ridges 6 and 8 in this area approaches zero adjacent the junction point with the protruding parts of binding plate 13. See FIG. 2. Otherwise, sole plate member 2 in this area would be pressed upwards, so that its bottom face would not come into contact with binding plate 13. In some instances, however, groove 4 may extend forward to engage and straddle the side faces of the ski in the vicinity of side walls 15, since these walls normally extend somewhat backwards relative to binding plate 13.

In a preferred form of sole plate member 2, shown in FIGS. 1–4, opposing side walls 6 and 8, defining groove 4, extend from a point slightly rearward of the forwardmost end of the shoe upper continuously to the rear edge of the heel of sole plate member 2. Side walls 6 and 8, however, do not extend into toe extension 17, i.e., that portion of the sole in front of the shoe upper which is received in toe binding 11. As mentioned above, such continuous side walls provide good lateral ski control through substantially all up and down foot motion. Triangular shaped cutouts 19 are preferably formed in side walls 6 and 8 in the forefoot area to add flexibility to sole plate member 2 during walking and skiing. Cutouts 19 also improve traction during walking.

Figure 1:
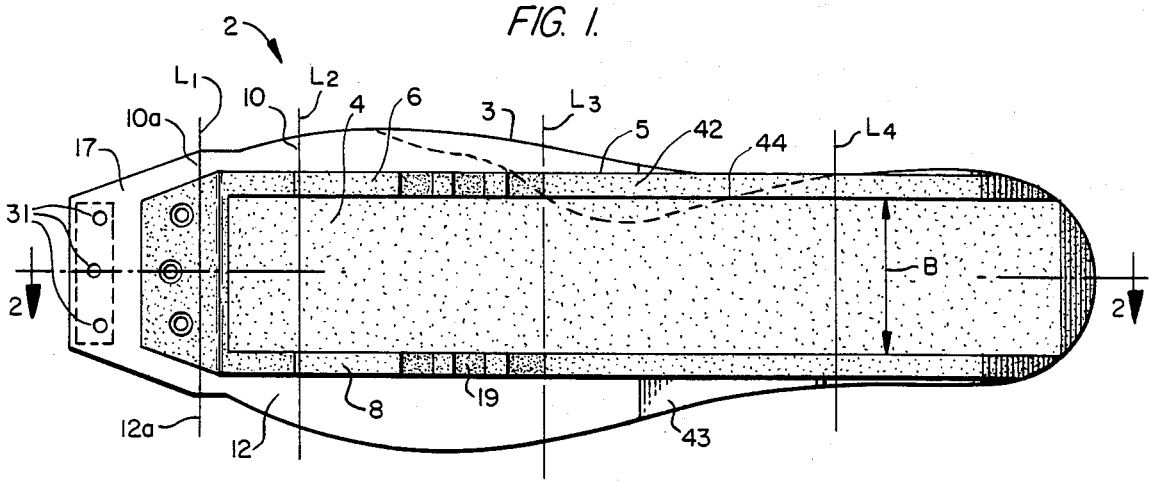
FIG. 1 is a plan view of one embodiment of a sole in accordance with the present invention.

As best seen in FIG. 1, the medial intermediate portion (in the arch area) of sole plate member 2 is provided with a laterally extended portion 42. Extended portion 42 allows groove 4 to be continuously extended backwards all the way to the heel section of sole plate member 2. Without this lateral extension the sole plate member 2 might typically follow dashed lines 44, thus interrupting groove 4. Medial extension 42 also provides additional medial support for the foot. Thus, the use of full length sole groove 4 in combination with medial extension 42 provides a more stable base of support under the foot, better balance medially and laterally over the ski, and more direct transmission of medial pressure from foot to ski when controlling turns with the inside edge of the ski. An extension 43 may also be provided on the lateral side of sole plate member 2.

Figure 6A:
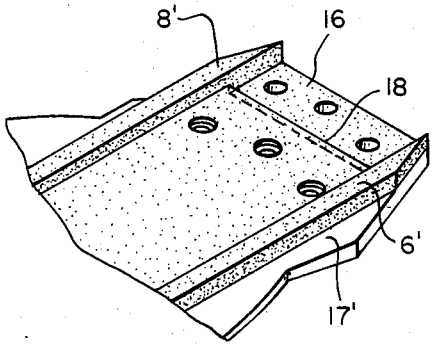
FIG. 6 is a perspective view of the bottom side of the sole of FIG. 5.
Figure 6:
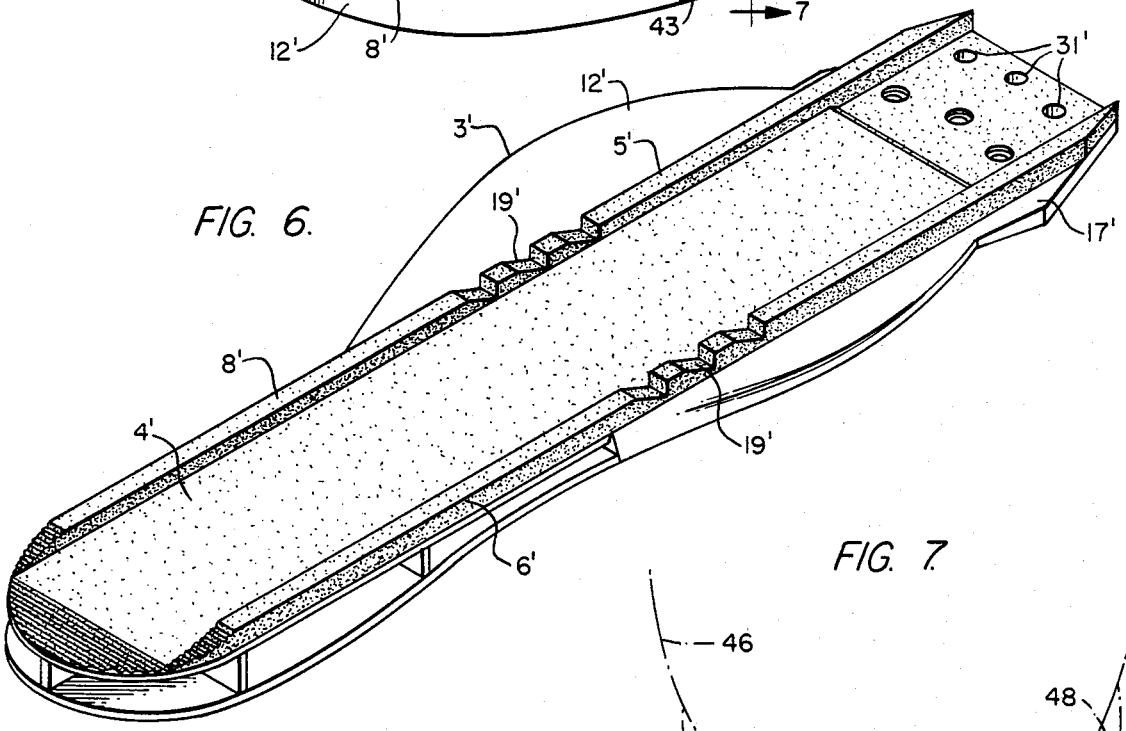

FIGS. 5 and 6 illustrate another embodiment of sole plate member 2' in accordance with the present invention. Elements of sole plate member 2' similar to elements of sole plate member 2 will be indicated by like primed numbers. Sole plate member 2' can be described briefly since it is the same as sole plate member 2 except for the extent of groove 4'. In sole plate member 2', side walls or edges 6', 8' extend to the forwardmost end of sole plate member 2', i.e., into toe extension 17'. Toe bindings in accordance with the present invention, which are adapted to accomodate sole plate member 2'0 are shown in FIGS. 8–11.

Other optional features of a sole in accordance with the present invention are shown in FIGS. 6*a* and 7. In FIG. 6 toe extension 17' is shown with a recess 16 extending below a transverse edge 18. The depth of recess 16 can be made in varying thickness and the longitudinal location of transverse edge 18 can be varied to adapt sole plate member 2' to various bindings having binding plates of various thicknesses.

FIG. 7 schematically shows a ski boot or shoe 46 which is provided with a special intermediate buildup or filler 48 along the medial side. Filler 48 fills out the space between the lateral extended portion 42 and the outside of the shoe, and serves as an external extra support for the foot and for the portion of the shoe resting against the sole and the ski. It will be understood that in place of an external intermediate build up, the ski boot itself can be made with a lateral extension and provided with an internal build up or support.

FIGS. 8 and 9 illustrate an embodiment of a new toe binding design in accordance with the invention, mounted on a ski in a clamped position on a cross-country ski shoe provided with a sole plate member 2' in accordance with the invention. The binding 50 is especially developed to be used in connection with the sole plate member 2' embodiment having a longitudinal groove extending all the way to the front or tip of the sole, i.e. into toe extension 17'.

Binding 50 comprises a binding plate 60, a bolt 70, a clamp 72, and a clamp retainer, i.e., a wing nut 76. Plate 60 is attached to the top side of the ski 62 by means of screws 63 and has a transverse upright flange 64 across its front end. Plate 60 includes three conventional marks or pins 66, of standard type, "nordic norm," for holding a shoe sole 68, provided with complementary apertures. Upright bolt 70 is attached to plate 60 and bolt 70 passes through a hole in clamp 72. The front edge of clamp 72 has a downwardly pointing flange 74 which rests against the inside of the flange 64 on the plate 60. Wing nut 76 is threaded onto bolt 70. A helical spring 78 is placed on bolt 70 between clamp 72 and plate 60. A stopper 80 is formed on the uppermost end of bolt 70. When the shoe is to be fastened into binding 50, wing nut 76 is initially screwed upwards. The tip of sole 68 is correctly positioned below the rear edge of the clamp 72 and is tipped somewhat upwards about a transverse pivot axis which will extend substantially through the bolt 70, simultaneously as the lower edge of the flange 74 hits the plate 60. Clamp 72 is kept biased against wing nut 76 by means of the spring 78. When sole 68 is arranged in binding 50 in engagement with the pins 66, wing nut 76 is tightened until the clamp 72 is pressed firmly against the toe extension of sole 68. Clamp 72 is pressed directly above the pins 66 and completely locks the sole. Downwardly pointing side edges 82 and 84 of sole 68 rest against the opposed side edges of plate member 60 and the ski 62. Plate member 60 is preferably designed with a width which substantially corresponds to the width of the ski.

Another embodiment of binding in accordance with the invention, which is shown in FIG. 10, differs from binding 50 shown in FIGS. 8 and 9 substantially in that threaded wing nut 76 on bolt 70 is replaced by a pivot arm 90 journalled on a transversely extending shaft 92 mounted on the top of bolt 70. Pivot arm 90 is provided with a substantially circular head 94 which is eccentrically mounted on the pivot shaft 92. In FIG. 10 the binding is shown in position for use, i.e., in locked position, wherein the pivot arm is pivoted forwardly down to rest against the ski 62. Eccentric head 94 is configured such that the biasing point against clamp 72 in this locked position is behind the axis through bolt 70, in other words, it is locked. Bolt 70 is attached to plate 60 on the ski, suitably with a threaded bushing 96. The clamping effect from the pivot arm 90 may be adjusted in a simple fashion by turning the pivot arm to rotate bolt 70 and thus move bolt 70 upwards or downwards with respect to bushing 96. If the pivot arm, for example, is turned one full turn to the right, one can obtain an increased clamping effect from clamp 72. Clamp 72 has a groove or a curvature 98 in the vicinity above pins 66. A transverse line contact with the shoe sole which further contributes to effective clamping is thus obtained. Curvature 98 also allows the shoe sole a better opportunity to attain a curved position during the skiing.

The binding shown in FIG. 10, similar to the binding shown in FIGS. 8 and 9, was especially developed for use in connection with a sole having a longitudinal groove and downwardly pointing portions 82, 24, along opposed side edges. These bindings may, however, without alterations also be used in connection with standard soles. The clamps shown in FIGS. 8–10 are usually made somewhat narrower than the front of the sole, such as shown in FIG. 9. However, the clamp can be made with substantially the same width and shape as the front portion of the sole, and further can have downwardly pointing side walls at opposed sides which straddle against the opposite side edges of the sole. Such an embodiment of a binding in accordance with the invention is shown in FIG. 11, which illustrates a binding 58 with an eccentric pivot arm 90 similar to the one shown in FIG. 10. However, in this embodiment, clamp 72 is pivotally attached to the plate 60 by means of a transverse shaft member 100. Furthermore, clamp 72 has the same width and form as the tip portion of the sole and at its opposite side edges is provided with downwardly pointing flanges or walls 102, 104, which straddle the tip (toe extension) of the sole. This embodiment of the binding can be used in connection with the soles in accordance with the invention, as well as with various forms of standard soles. The downwardly pointing side walls 102, 104, will then serve the same or a similar function as the usual upwardly pointing side walls used on standard bindings.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

I claim:

1. An outer sole for a cross-country ski shoe wherein the shoe moves upward and downward with respect to the ski during skiing, said sole comprising a flexible sole plate member having a toe section, a forefoot section, an arch section, a heel section, an upper surface for attachment to a shoe upper and a lower surface adapted to contact a ski, said lower surface having a pair of transversely spaced, longitudinally extending side walls defining between them a longitudinally extending groove, said groove having a width sufficient for receiving the ski so that said side walls of said groove extend about the side walls of the ski, said groove extending through at least said forefoot, arch and heel sections so that in normal cross-country skiing motions some portion of said side walls of said groove extend about the side walls of the ski to provide lateral stability.

2. An outer sole in accordance with claim 1 wherein said groove extends into the toe section of the sole.

3. An outer sole in accordance with claim 1 or 2 wherein said sole plate member includes a toe extension adapted to be coupled to a binding on the ski.

4. An outer sole in accordance with claim 3 wherein said groove extends into said toe extension.

5. An outer sole in accordance with claim 1 or 2 wherein said sole plate member includes a lateral extension portion along the medial side of the sole, said lateral extension portion extending outward past the medial side edge of the ski to which the sole is to be attached and through the arch section of the sole.

6. An outer sole for a cross-country ski shoe wherein the shoe moves upward and downward with respect to the ski during skiing said sole comprising a flexible sole plate member having a toe section, a forefoot section, an arch section, a heel section, a toe extension adapted to be coupled to a binding on a ski, an upper surface for attachment to a shoe upper, a lower surface adapted to contact the ski, and a lateral extension portion on the medial side of said arch section, said lateral extension portion extending past the medial side edge of the ski and through the entire arch section, said lower surface of said sole plate member having a pair of transversely spaced, longitudinally extending side walls defining between them a longitudinally extending groove, said groove having a width sufficient for receiving the ski so that said side walls of said groove extend about the side walls of the ski, said groove extending from said toe section, and through said forefoot, arch and heel sections so that in normal cross-country skiing motions some portion of said side walls of said groove extend about the side walls of the ski to provide lateral stability.

7. An outer sole in accordance with claim 6 wherein said side walls of said groove have a depth from the bottom surface of the groove between approximately 4 and 7 mm.

8. An outer sole in accordance with claim 6 or 7 wherein the bottom surface of said groove is substantially flat through substantially its entire extent.

9. A cross-country ski shoe wherein the shoe moves upward and downward with respect to the ski during skiing, said shoe comprising a shoe upper and an outer sole, said outer sole including a flexible sole plate member having a toe section, a forefoot section, an arch section, a heel section, a toe extension adapted to be coupled to a binding on a ski, an upper surface attached to said shoe upper, a lower surface adapted to contact a ski, and a lateral extension portion on the medial side of said arch section, said lateral extension portion extending past the medial side edge of the ski and through the entire arch section, said lower surface of said sole plate member having a pair of transversely spaced, longitudinally extending side walls defining between them a longitudinally extending groove, said groove having a width sufficient for receiving the ski so that said side walls of said groove extend about the side walls of the ski, said groove extending from said toe section and through said forefoot, arch and heel sections so that in normal cross-country skiing motions some portion of said side walls of said groove extends about the side walls of the ski to provide lateral stability.

* * * * *

UNITED STATES PATENT AND TRADEMARK OFFICE

CERTIFICATE OF CORRECTION

PATENT NO. : 4,514,916

DATED : May 7, 1985

INVENTOR(S) : Kjell Aarflot

It is certified that error appears in the above—identified patent and that said Letters Patent is hereby corrected as shown below:

Column 6, line 25, "2'0" should be —2'—.

Signed and Sealed this

*Twenty-seventh* Day of *August 1985*

[SEAL]

*Attest:*

DONALD J. QUIGG

*Attesting Officer* *Acting Commissioner of Patents and Trademarks*